US007156187B1

(12) United States Patent
Townsan

(10) Patent No.: US 7,156,187 B1
(45) Date of Patent: Jan. 2, 2007

(54) ELECTRIC HAND SCREWDRIVER WITH ADJUSTABLE HEAD

(76) Inventor: Joel Townsan, 124 N. 103rd St. #402, Seattle, WA (US) 98133

( * ) Notice: Subject to any disclaimer, the term of this patent is extended or adjusted under 35 U.S.C. 154(b) by 40 days.

(21) Appl. No.: 11/129,180

(22) Filed: May 13, 2005

(51) Int. Cl.
*E21B 19/081* (2006.01)
*E21B 23/02* (2006.01)
*E21B 10/26* (2006.01)

(52) U.S. Cl. ..... 173/1; 173/217; 173/216; 81/57.13

(58) Field of Classification Search ..... 173/1, 173/216, 217, 163; 81/57.13, 57.2, 177.7, 81/177.9
See application file for complete search history.

(56) References Cited

U.S. PATENT DOCUMENTS

| | | | | |
|---|---|---|---|---|
| 1,970,369 | A | 8/1934 | Focht | |
| 2,348,266 | A | 5/1944 | Selby | |
| 2,414,637 | A | 1/1947 | Crump | |
| 2,584,172 | A * | 2/1952 | Underwood | 384/606 |
| 4,970,918 | A | 11/1990 | Brewer et al. | |
| 5,251,706 | A | 10/1993 | Evans | |
| 5,355,751 | A * | 10/1994 | Specht | 81/57.14 |
| 5,372,420 | A | 12/1994 | Van Deursen et al. | |
| 5,533,581 | A | 7/1996 | Barth et al. | |
| 5,609,077 | A * | 3/1997 | Ohmi et al. | 81/57.13 |
| 5,784,934 | A | 7/1998 | Izumisawa | |
| D436,819 | S | 1/2001 | Liu | |
| 6,168,287 | B1 | 1/2001 | Kuo-Chen | |
| 6,293,172 | B1 | 9/2001 | Smith | |
| 6,543,314 | B1 * | 4/2003 | Hoyt | 81/57.29 |
| 6,739,221 | B1 * | 5/2004 | Cha | 81/57.13 |
| 6,796,385 | B1 | 9/2004 | Corbzaru et al. | |

* cited by examiner

*Primary Examiner*—Sameh H. Tawfik
*Assistant Examiner*—Nathaniel Chukwurah
(74) *Attorney, Agent, or Firm*—Matthew W. Jellett; Hughes Law Firm, PLLC

(57) ABSTRACT

An electric powered handheld screwdriver having a main body and a reaching arm. The main body has a power source, a drive motor, and a drive shaft. Attached to the outer portions of the main body are a plurality of screwdriver bits. The power source is a removable rechargeable battery pack. The reaching arm is composed of two sections: a front section and a rear section. The rear section has two transversely aligned drive shafts. The first drive shaft is connected to the main drive shaft of the drive motor. The first drive shaft is then connected to a series of longitudinally aligned transmission gears which are offset from the center line of the motor main drive shaft. The gears are then connected to the second transversely aligned drive shaft and this drive shaft is connected to the spindle. The spindle is powered by the second drive shaft and has the ability to rotate about the second drive shaft. The spindle is encased by a housing which also has four LED elimination lights to provide lighting within the small space.

20 Claims, 7 Drawing Sheets

(30 DEG.)

(45 DEG.)

(75 DEG.)

(90 DEG.)

(105 DEG.)

ELECTRIC HAND SCREWDRIVER WITH ADJUSTABLE HEAD

BACKGROUND OF THE INVENTION a) Field of the Invention

This present concept relates to an electric hand tool, particularly portable electric screwdrivers. In general, portable electric screwdrivers come in two general categories. The first category is specifically designed to replicate or act more as a portable electric hand drill. These hand drills are configured in the general shape of a handgun having a lower handle section running essentially vertically, with a transverse body section where the motor is housed in the drive shaft which turns the spindle. The spindle head has a chuck which holds either the drill bit or the screwdriver bit. Generally, the power source is contained within the handle portion and provides for enough space to store a large battery with significant amounts of power to run the drill for long periods of time. The spindle chuck is generally fixed in one direction or location offering limited range of movement.

The second category of portable electric screwdriver is one that is generally designed to replicate a handheld screwdriver. The housing on these portable handheld devices is generally cylindrical and has a power source in the handle section which is limited in size to the housing thus providing for a small battery with less amount of power to run for a limited period of time. The motor is also contained within the housing and drives a drive shaft which is connected to the screwdriver bit spindle section. In either case, users commonly encounter situations where they need to access small spaces such as car doors, home appliances and the like, where the use of a portable electric hand screwdriver with a spindle head which can pivot throughout a large range of angular positions within the small space, would be very beneficial to completing their respective tasks.

The following patents disclose a wide range of electrically powered hand tools.

b) Background Art

U.S. Pat. No. 1,970,369 discloses a coal drilling apparatus in Col. 1 line 33, a truck frame is mounted to an axel system and these are fitted with wheels that are adapted to rest upon and travel on rails. Further down at line 40, the mechanism has an electric motor connectable to a gearing with a chain and axles which actually change. The drilling mechanism is mounted upon a turntable carried by the truck frame. On the turntable is a motor which actuates the drilling mechanism. The motor is electric. A shaft is connected to the motor through the spur gears and the shaft has an arm with a locking member adapted to engage suitable apertures within the annular flange of the rim of the frame. By locking the member, the arm may be held in a preferred position of angular adjustment about the shaft.

U.S. Pat. No. 2,414,637 discloses a universal drill support. This device relates to machine or hand tools and a drill adapted for universal movement. The tool is adapted for universal swivel movement and a full 360° in 2 directions at right angles to each other. Referring to Col. 1 at line 27, a universal drill has an elongated handle member with a bore extending the length of the handle. The bore receives the bearing for a shaft on which a thrust collar is positioned and secured by a pin.

U.S. Pat. No. 5,533,581, discloses an electric hand tool, in particular a drill with a housing, an electric motor, a motor shaft parallel to the housing axis, a work spindle driven by the electric motor, work spindle driven by transmission gearing, the housing divided along a dividing plane for the purpose of switching from straight drilling to angular drilling. The drill spindle as referred to in Col. 4 at line 3 is rototably supported in a bearing of the housing and projects out of the housing. The drill spindle carries a drill chuck at its free and protecting out the housing for clamping a drill bit. Housing is divided along a dividing plane, into a front housing part for the drill spindle and a rear housing part containing the motor and the motor shaft. The dividing plane is situated at an angle of 45° relative to the axis of the motor shaft. The transmission gearing further down in Col. 4 at line 33, between the motor shaft and the spindle extends parallel to the motor shaft, but offset relative to the motor shaft.

U.S. Pat. No. 6,796,385 discloses a fastener driving machine and associated method. The machine is advantageously structured to provide a substantially constant level of torque to a delivery point on the head of the machine independent of the position of the head with respect to the driver. The machine is referred to in Col. 2 outline 57, has a driver structured to provide a given level of torque and also includes a transmission apparatus. The transmission has a gear mechanism, a support, an index, a head, and a structure to transmit the mechanical effort between the driver and the head. The index apparatus that is a first portion in the second portion with the first and second portions biased towards one another. With regard to adjusting the head to various conditions and configurations, referring to Col. 11 outline 17, to adjust the head and therefore move the delivery point in one position to another the lock rings unthreaded from the first teeth. The indexing housing and support are pulled apart to disengage the first and second teeth and the indexing housing is rotated with respect to the support until the desired position is achieved.

U.S. Pat. No. 2,348,266 discloses an angle tool holder for angle drills. An attachment is provided which can be easily connected to the usual spindle or chuck of a cutting or drilling machine, for instance the chuck of a portable drill. In Col. 2 at line 6, the casing has two complementary hollow sections. There is an upper hollow section and a lower hollow section, which face each other and are arranged around a vertically aligned bolt. Thus the upper or lower sections can be adjusted relative to one another in the radial direction around the bolt, the bolt being tightened and loosened to allow fixation or adjustment of the sections. Further, at line 53 Col. 2, the upper section has a shank extending outward so the ringed right angle from the bolts. The end of the upper shank extends outside of the shank and can be engaged with the spindle or tool holder. The end of the lower shank extends outside of the lower casing and can hold the tool. Rotation is provided from the upper shank through a gear transmission and into the transmission arranged around the vertical bolt. The rotation is then transmitted into a gear transmission which is connected to the lower shank. When the upper shank is rotated, and referring to Col. 3 at line 19, transmits rotation through the double gears of the transmission to the lower shank and rotates to the tool bit.

U.S. Pat. No. 5,372,420 discloses a device having a rotatable head with a housing having a first and second housing member. First housing member is rotatable relative to the second housing member between the first and second operating positions. The longitudinal axis of the first housing member is disposed substantially 90° relative to the longitudinal axis of the second housing member when in the first operating position. The longitudinal axis of first housing member is disposed coaxial with the longitudinal axis the second housing member when in the second operating position. A locking arm engages in the first housing member for retaining the member in the desired positions.

U.S. Pat. No. 6,168,287 discloses a combination of an electric power tool and an illuminating device received in the tool. Power tool has a handle for receiving batteries and a barrel with a drive shaft rotatably connected to the end of the barrel portion. The drive shaft is controlled by a switch which is electronically connected to the batteries of the drive shaft. An illuminating device includes two light bulbs attached to the drive shaft and being electronically connected to the switch so that by turning on the switch the bulbs illuminate. Further in Col. 2 at line 11, the electric power tool has a handle, a barrel, batteries within the barrel, with a cap on the lower end of the barrel to contain the batteries, a drive shaft from the barrel portion, a switch connected to the barrel portion, the switch electronically connected to the drive shaft and the batteries, the drive shaft actuated by the switch and the batteries, the illuminating device having two bulbs and electrically connected to the switch.

USD 436,819 discloses an electronic screwdriver, which is a designed for the casing of an electronic screwdriver which seems to be in the shape of a portable electronic drill. The ornamental design shows a lower handgrip arranged in the vertical direction and an upper cylindrical shaped head casing arranged in the longitudinal direction with what seems to be a screw driver bit adjustable holder mechanism at the head of the casing.

U.S. Pat. No. 5,784,934 discloses a ratchet wrench with pivotal head. The ratchet wrench has a handle for gripping and a head having a ratchet mechanism including a drive shaft capable of powered rotation about its axis. The head and handle have openings in registration with one another and a pin is received through the openings interconnecting the handle and head, which permits pivoting movement of the handle and head relative to one another about a longitudinal axis of the pin to any multiplicity of selected angular orientations. The ratchet wrench includes a transmission constructed to transmit power from the motor to the ratchet mechanism through the pin interconnection of the handle and head.

U.S. Pat. No. 5,251,706 discloses a ratchet drive tool with manual and non-manual power actuation where the power source is supplied by a battery, or an electrical or pneumatic supply. A drive shaft extends coaxially from the housing which contains speed reducing/power amplifying structures and the drive shaft is connected to the head of the device through a pivot joint assembly.

U.S. Pat. No. 6,293,172 discloses a telescopic pocket door angle drill which has a right angle driver with a telescopic handle portion which can be extended to reach into confined spaces. The right angle driver has a casing and an internal gear assembly for translating rotary motion from horizontal drive to a vertical drive.

U.S. Pat. No. 4,970,918 discloses an adjustable tool for manipulating a fastening device such as a bolt or screw. The tool has a handle which is rotatable about a shaft, the shaft being inserted through the handle. A housing pivots about one end of the handle and has an end which can be rotated to manipulate a fastening device at angles of 0 degrees, 90 degrees, and 270 degrees from the drive shaft.

SUMMARY OF THE INVENTION

The current embodiment is designed to allow the use of an electronic handheld screwdriver to access securing devices located within small environments.

Accordingly, one aspect of the current embodiment includes a handheld electric screwdriver which has a main body and a reaching arm. The main body holds the power source in the drive motor. The reaching arm contains the drive shaft, transmission, and spindle.

The reaching arm is configured so that it has a reasonably narrow profile or height. Additionally, the spindle, which holds the screwdriver bit, can pivot about the transverse axis. This is so that when the screw contained within the small environment is at an angle which deviates from the axis of the rest of the screwdriver, the spindle and spindle housing can be positioned and locked in place to achieve the proper normal presentment of the screwdriver bit to the screw.

To provide for a large degree of rotational freedom about the transverse axis, the drive shaft which would normally extend up into the spindle housing has been terminated at the base of the reaching arm and the drive force has been transferred transversely to a series of off-center longitudinally aligned transmission gears. By breaking up the location of the drive shaft, the spindle housing can rotate about the transverse axis past what normally would be only 90° from horizontal plane to approximately 105° or more depending on the length of the spindle extending past the housing.

Sometimes the environment in which the reaching arm is being utilized is relatively dark, therefore four LED lighting units have been installed into the spindle housing for illumination of the environment.

These and further features and advantages of the present embodiment will become obvious from the following description when taken in connection with the accompanying drawings, which show, for purposes of illustration only, several embodiments in accordance with the current embodiment.

DETAILED DESCRIPTION OF THE PREFERRED EMBODIMENTS

Figure 1:
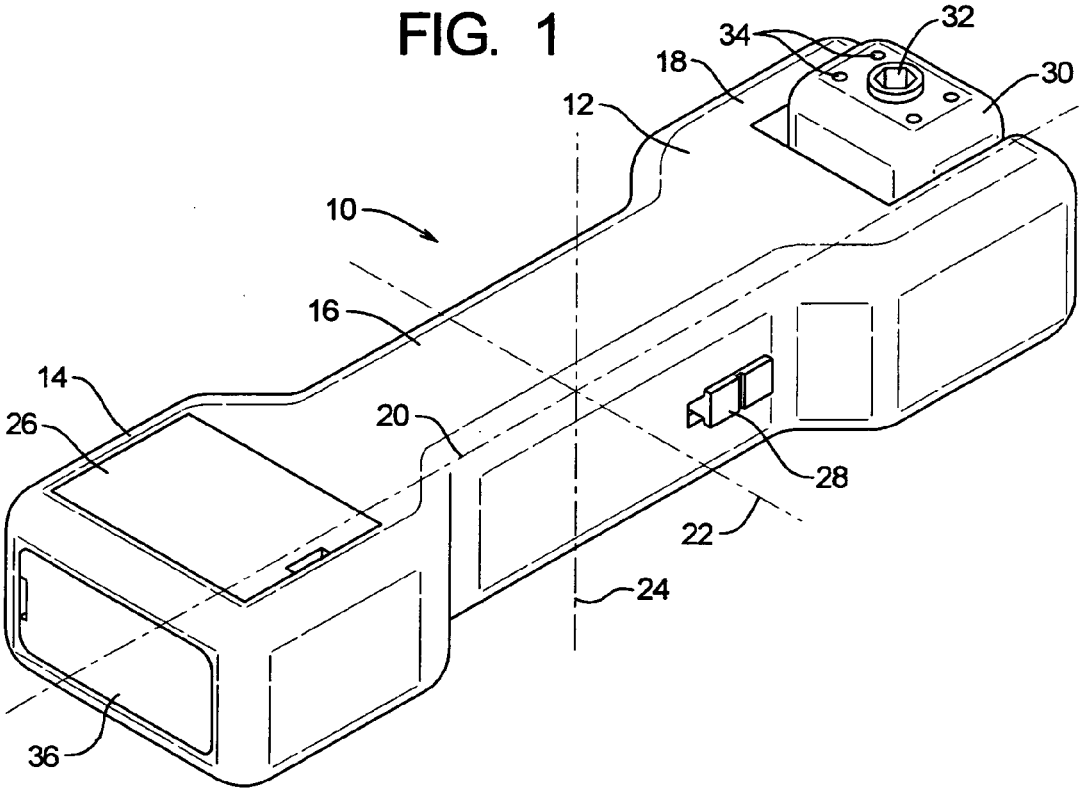
FIG. 1 is a perspective view of the handheld electric screwdriver.

With the foregoing in mind and in light of the existing prior art, referring to FIG. 1, a portable electric handheld screwdriver 10 is shown. In the current embodiment, the portable electric handheld screwdriver 10 has a housing 12 having a lower end 14, a middle handle section 16, and an upper head section 18. The middle handle section is narrower than the lower end 14 and the upper end 18, to provide for ease of gripping for individuals with smaller hand sizes.

In order to provide power to the motor of the electric hand screwdriver, a removable rechargeable battery is provided in the housing at the low end 14 of the housing. In order to provide for a significant useful life for the hand screwdriver 10, the lower end 14 of the housing has been enlarged to receive a rechargeable battery pack 40 of reasonable size and capacity.

The housing 12 is arranged along a longitudinal axis 20, a transverse axis 22, and a vertical axis 24. Referring now to both FIGS. 1 and 2, in the current embodiment, the lower end 14 of the housing has encased within it a removable rechargeable battery 40, which can be removed through a battery hatch 36 connected on to the bottom face of the housing 12.

Many times, a user will need to utilize more than one type of screwdriver head on the project. Thus, included on the outside face of the housing lower end 14 is a bit holder compartment 26 which is configured to hold the screwdriver head bits when not in use. For example, screwdriver bits could be configured for various Phillips head sizes, as well as Flathead sizes to provide the user with an easy assortment of drill bits or screwdriver bits for use during their project.

The portable electric handheld screwdriver 10 is turned on and off by the power button 28 located on the side face of the housing middle section 16. Positioning the power button 28 at this upper side face location enables a user to engage the power button with his or her thumb.

As previously discussed in the background section, many portable electric screwdrivers have a drill chuck and bit holder which is either fixed in a specific location relative to drive shaft, or is so large that movement of the drill chuck to various angular positions will not provide for ease of use of the portable screwdriver within a relatively small space configuration. To alleviate these problems, protruding out of the upper housing portion 18, is a spindle housing 30 which holds a series of LED lights 34 as well as the magnetic spindle shaft 32 which holds the screwdriver bits discussed previously. The spindle housing can rotate 210° around the transverse axis and along the vertical and longitudinal plane. As will be discussed below, the magnetic spindle shaft 32 is designed to keep a relatively small profile, meaning that it will not extend in the vertical direction very far past the housing limits.

To provide for an efficient use of space within the housing, as well as the efficient transfer of power from the battery pack, to the motor, to the drive shaft and then to the spindle, the main components of the handheld electric screwdriver 10 are positioned along the longitudinal axis.

Figure 2:
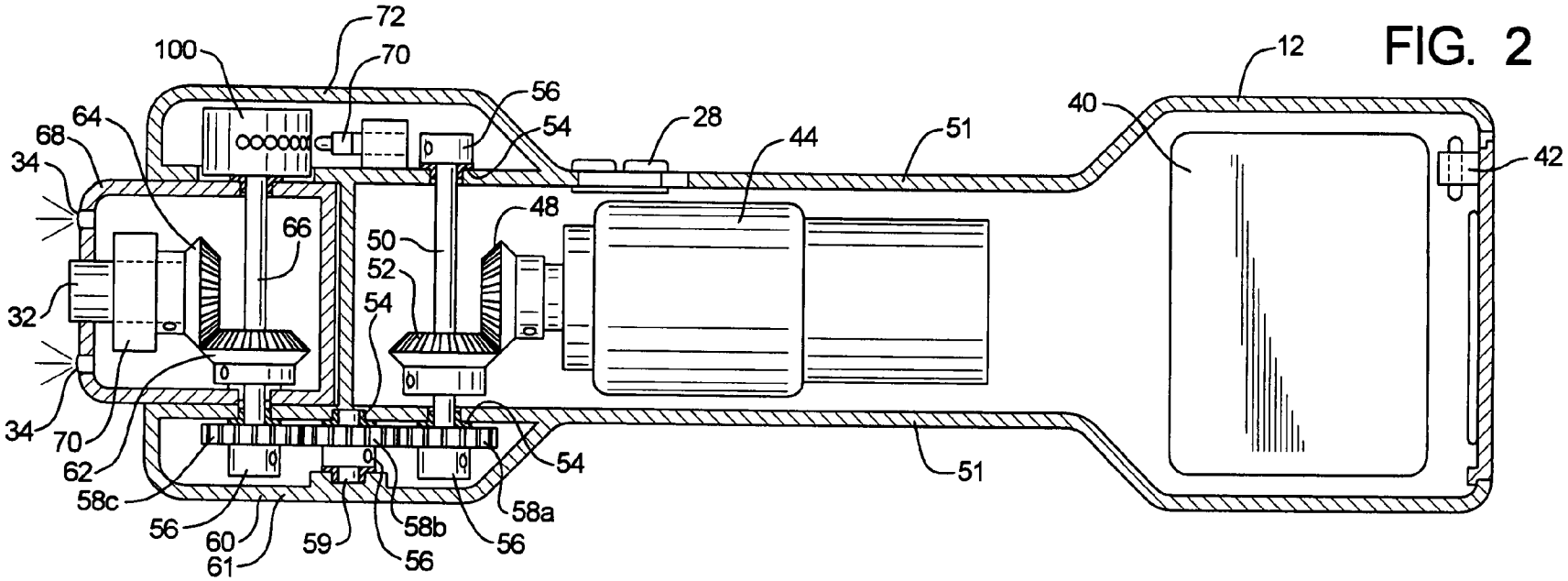
FIG. 2 is a plan view of the handheld electric screwdriver.

Still referring to FIG. 2, and discussing the inner workings of the portable electric handheld screwdriver 10, the rechargeable battery 40 is connected to a motor with gearbox 44, the motor 44 driving a drive shaft 46 which in turn is connected to a drive shaft miter gear 48. The drive shaft of the motor 46 is positioned in parallel with the longitudinal direction of the housing 12.

In general, handheld screwdrivers have been provided where the spindle or bit holder section can pivot rotationally perpendicular to the shaft of the screwdriver. The pivoting angular distance is naturally limited by the interference of the shaft. Taking for example a typical handheld ratchet or screwdriver having a pivoting head, the head might start parallel to the screwdriver shaft at a zero degree position. Rotating either positive or negatively, the head might rotate to a 90 degree negative rotation position. The user may then wished to rotate the head position further, but may be limited in rotating to 90° by the actual physical interference of the screwdriver shaft and the thickness of the screwdriver ahead. At best, the user might be able to obtain a 60° rotation.

To provide for an additional range of rotation of the spindle head 30, instead of extending longitudinally forward and connecting with the magnetic spindle shaft and bit holder, the drive shaft 46 terminates immediately after exiting the motor 44.

The drive shaft miter gear 48 provides for interoperability with a first transverse shaft miter gear 52. In order to be positioned for interoperability, the transverse miter gear 52 is positioned on a lower transverse drive shaft 50. The lower transverse drive shaft 50 is supported by the housing sidewalls 51. Embedded within the housing sidewalls 51 are ball bearings 54 which allow the transverse drive shaft 50 to rotate freely about the transverse axis. To fix the shaft into position, shaft collars 56 are provided at the ends of the transverse drive shaft 50 so that the drive shaft 50 and transverse shaft miter gear 52 stay in their proper position relative to the transmission.

Still referring to FIG. 2, to transfer the drive power ultimately to the magnetic spindle shaft 32, a series of off-center, longitudinally aligned spur gears 58 are provided outside of the main housing area in an off-center spur gear casing 60 is configured on the side of the main housing to encompass the spur gears 58. The lower transverse drive shaft 50 extends through the main housing sidewall's 51 and into the spur gear casing 60. A first longitudinally lower positioned spur gear 58A is connected to the lower transverse drive shaft 50. Lower transverse drive shaft 50 extends through this spur gear 58A and terminates in the casing 60. Attached to the end of the drive shaft is a shaft collar 56. Positioned longitudinally forward of the first spur gear 58A is an intermediate spur gear 58B. This intermediate spur gear 58B is positioned on an intermediate gear shaft 59 which is supported by the outside wall 61 of the spur gear casing and the main housing sidewall 51. This intermediate transverse spur gear shaft 59 sits in ball bearings 54 housed to the casing walls. Operatively connected to the intermediate longitudinally aligned spur gear 58B, is a forward positioned spur gear 58C.

This forwardly positioned spur gear 58C is connected to an upper transverse drive shaft 66. The upper transverse drive shaft 66 is longitudinally positioned away from the lower transverse drive shaft 50 to provide for the desired rotational freedom for the spindle housing 68.

The upper transversely aligned drive shaft 66 performs a number of various functions. First, the drive shaft is powered by the forwardly positioned spur gear 58C and is rotated about the transverse axis, thus rotating a connected upper transverse shaft miter gear 62. The miter gear 62 is connected operatively to an upper spindle miter gear which is orientated perpendicular to the upper transverse shaft miter gear 62. Thus, power from the transmission can be transferred from the upper transverse drive shaft 66 to drive the magnetic spindle shaft 32 which is operatively connected to the upper spindle miter gear 64. Secondly, the spindle housing utilizes the upper transverse drive shaft 66 as an axle to rotate throughout various angular positions around the center axis of the axle or upper transverse drive shaft 66. The drive shaft 66 is supported by the housing sidewalls 51, and the spindle housing 68, operates on the drive shaft 66 by rotating on ball bearing casings 54 mounted on the drive shaft 66 to allow the spinal housing 68 to move independently of the drive shaft 66.

Figure 3:
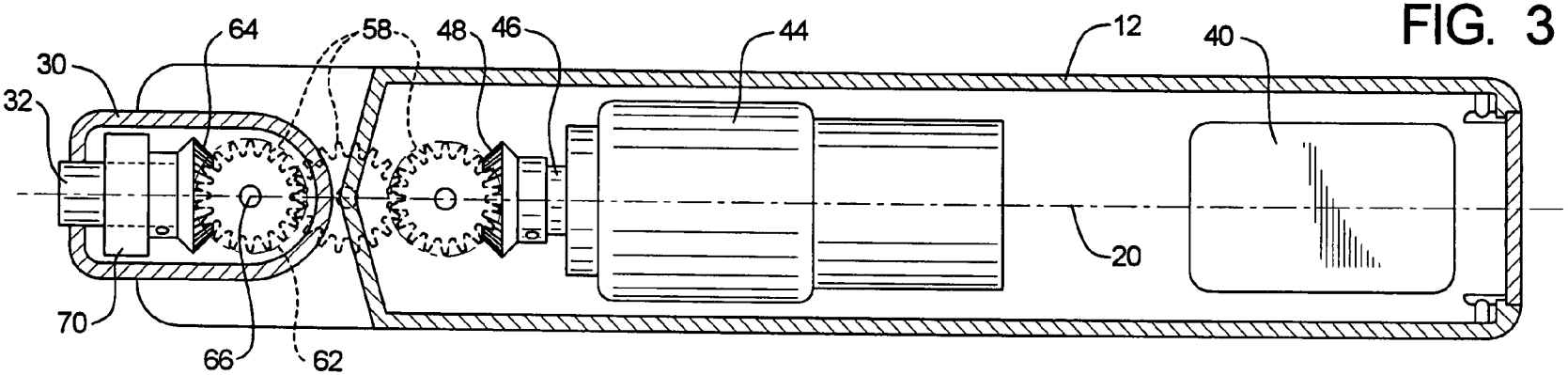
FIG. 3 is an elevation view of the handheld electric screwdriver.
Figure 3A:
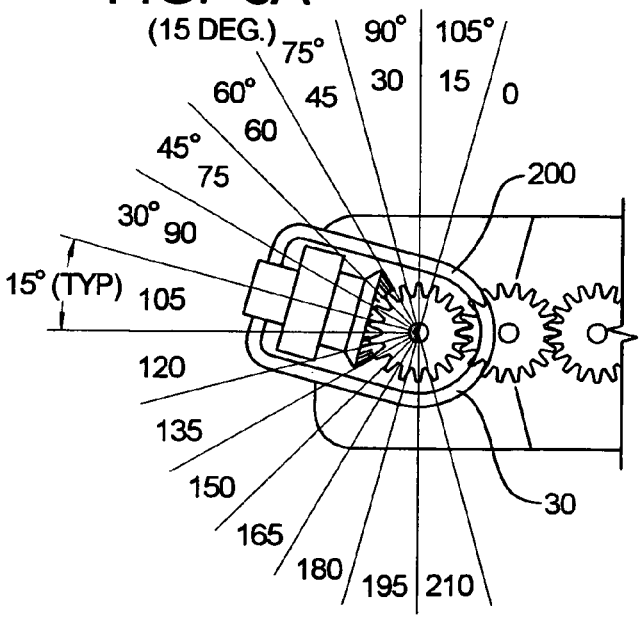
FIG. 3A is a detailed view of the spindle head rotated to a positive 15 degree position.

Referring now to both FIGS. 2 and 3, as stated previously, the majority of existing powered portable electric screwdrivers 10 have the spindle housing 30 fixed in a stationary position along the longitudinal axis 20 parallel or directly on center with the drive shaft 46. In the current embodiment, the spindle housing 30 has been disconnected from the drive shaft 46 and has been configured to allow varying degrees of rotational freedom around the central axis of the upper transverse drive 66.

The rotational degrees of freedom for the spindle housing 30 will now be discussed. Referring to FIG. 3, 3A through 3F, the spindle housing in its unrotated position is generally locked in it a zero degree or horizontal position to the longitudinal axis. The user, in the current embodiment, is able to fix the spindle housing 30 in rotational increments of 15°. It is conceivable that other incremental degrees of rotation can be provided for the fixation, including providing a locking mechanism which will allow for 360° of integral rotation, a locking mechanism providing one degree of freedom integral rotation, as well as a locking mechanism providing just 45° of freedom integral rotation.

Figure 3B:
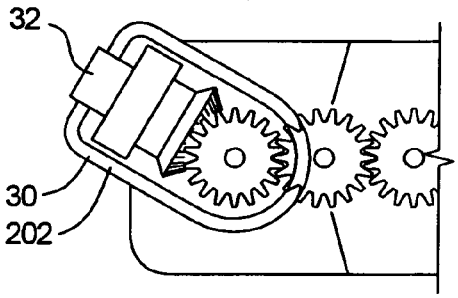
FIG. 3B is a detailed view of the spindle head rotated to a positive 30 degree position.
Figure 3C:
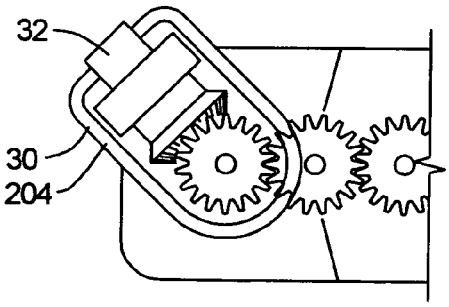
FIG. 3C is a detailed view of the spindle head rotated to a positive 45 degree position.
Figure 3D:
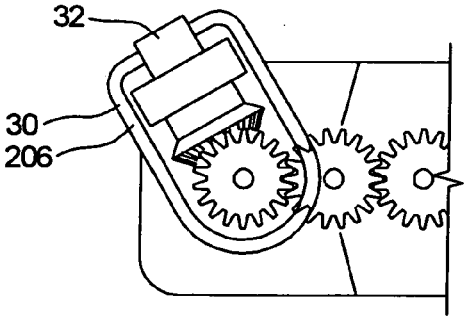
FIG. 3D is a detailed view of the spindle head rotated to a positive 75 degree position.
Figure 3E:
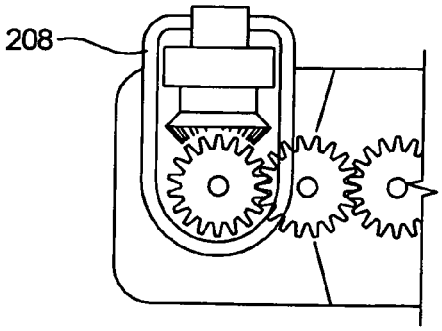
FIG. 3E is a detailed view of the spindle head rotated to a positive 90 degree position.
Figure 3F:
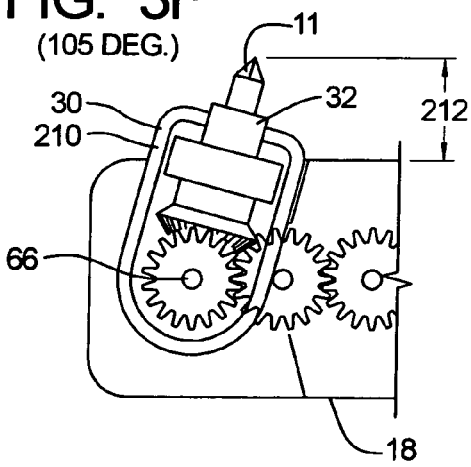
FIG. 3F is a detailed view of the spindle head rotated to a positive 105 degree position.

Referring to FIG. 3, the spindle housing 30 is fixed in a positive 15 degree rotational position 200, and then referring to FIG. 3B, the spindle housing 30 is rotated to a positive 30 degree rotational position 202, still rotating positively, the spindle housing 30, referring to FIG. 3C is positioned at a positive 45 degree rotational position 204. Moving along to a greater positional degree of freedom, the spindle housing 30, in FIG. 3D is positioned at a positive 75 degree rotational position 206, and then rotated in FIG. 3E to a positive rotational position of 90° 208. The user may wish to rotate even further then positive or −90° and position the drill bit 11 at a greater than 90° plane of rotation, thus referring to FIG. 3F, the spindle housing 30 has been rotated to a positive 105 degree rotational position 210. The magnetic spindle shaft 32 during the entire rotational operation has stayed above the main housing 16 to allow the screwdriver bit 11 to operate on the previously mentioned fastener 156, FIG. 1A.

Similarly, the spindle housing 30 can rotate in the negative rotational direction to provide for rotational configuration as the user desires.

In order to provide for the locking of the spindle housing 30 in the various rotational positions around the upper transverse drive shaft 66, a locking mechanism is provided on the opposite end of the upper transverse drive shaft 66 from the drive shaft miter gear 62 and integrated with the spindle housing 30.

Figure 6:
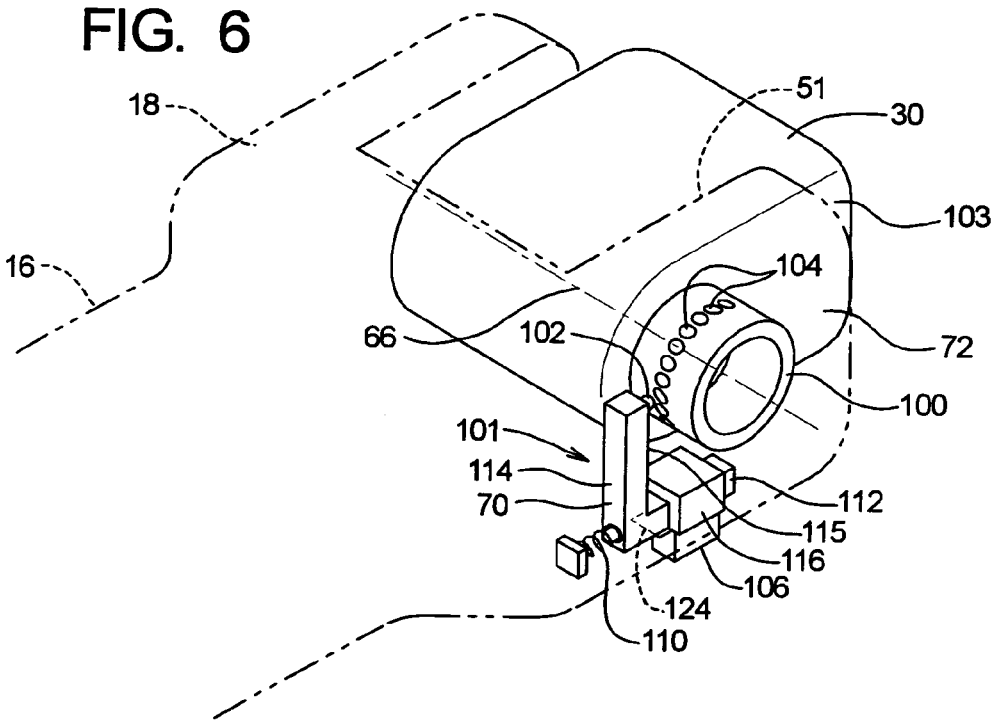
FIG. 6 is a perspective view of the rotational locking mechanism.

Referring first to FIG. 6, the rotational locking mechanism 101 as previously discussed is integrated with the spindle housing 30 as well as the upper main housing 16. The integration of the spindle housing 30 with the rotational locking mechanism 101 is through the use of a female catch lock collar 100. This catch lock collar is a cylinder which extends transversely from the sidewall 103 of the spindle housing 30.

Still referring to FIG. 6, the catch lock collar 100 has, spaced equidistantly around the perimeter of the cylinder, receiving pinholes 104 which correspond to varying angular fixed positions or degrees of freedom which the spindle housing 30 can be rotated throughout and positioned for screwdriver use.

The receiving pinholes 104 correspond to a male pin 102 which is connected to the vertical leg of a male catch lock 70. The vertical catch leg 114 has an upper end and a lower end with the male pin 102 protruding longitudinally forward from the forward surface 115 of the vertical catch lock leg 114.

To provide for smooth longitudinal translation, the male catch lock 70 has a forward longitudinal catch lock leg 112 which slides within a forward longitudinal catch lock sleeve 116.

Also, the current embodiment is designed for the rotational locking mechanism 101 to be positioned outside of the upper main housing 16 to avoid interference with the main transmission. To encompass the entire rotational locking mechanism 101, a catch lock casing 72 is provided which attaches to the outer portion of the housing sidewall 51 and mirrors the geometrical configuration of the spur gear casing 60, as seen in FIG. 2.

A compression spring 110 is provided and positioned at the lower end of the vertical catch lock leg 114. This compression spring, provides a longitudinal compressive force pushing the male catch lock 74 towards the female catch lock collar 100. By providing a compressive force through a spring 110, the male catch lock 70 will not slide out of position from the receiving pinholes 104 and the spindle housing 30 will not rotate out of position during use.

Figure 7:
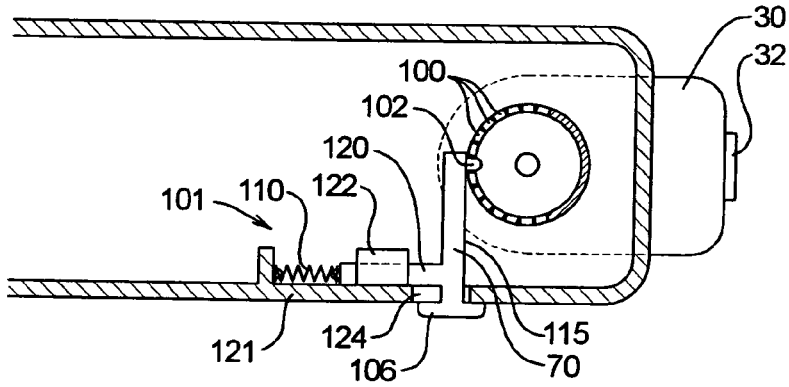
FIG. 7 is an elevation view of an alternative embodiment of the rotational locking mechanism.
Figure 8:
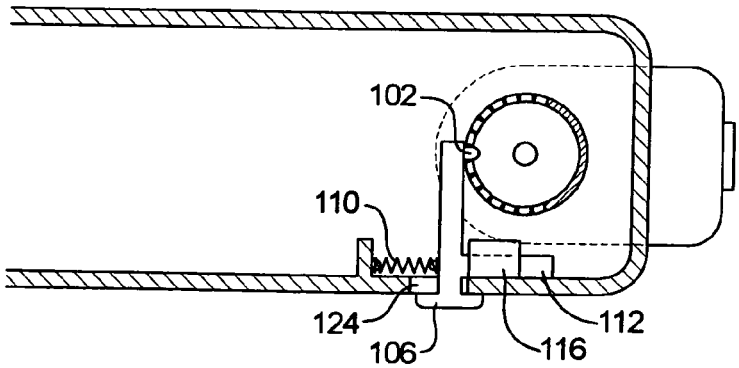
FIG. 8 is an elevation view of the rotational locking mechanism.

Referring to FIGS. 7 and 8, the rotational catch lock mechanism 101 has a button or catch lock actuator 106 which extends vertically downwards from the base of the vertical catch lock leg 114 through a catch lock slot 124 provided at the bottom wall 121 of the catch lock casing 72. In an alternative embodiment, the rearward longitudinal catch lock leg 120 is positioned behind the vertical catch lock leg 114 and connected to the bottom portion of the catch lock leg, and extends through a rearward longitudinal catch locked like sleeve 122 which has positioned behind it the compression spring 110. The catch lock 70 can move a longitudinal direction forward or rearward limited only by the distance of the catch lock slot 124. The catch lock slot 124 is designed to allow the male pin 102 to disengage from the female catch lock collar receiving pinhole 104 so that the user can then rotate the spindle housing 30 to its desired position.

In operation, the user will slide the button 106 backwards and disengage the catch lock pin 102 from the catch lock collar 100. The spring 110 will increase its compressive force, and after the user has rotated the spindle housing 30 to its desired position, the button 106 can be released and the compressive force in the spring 110 pushes the catch lock 70 into the desired pinhole 104 securing the spindle housing 30 in its desired rotational position.

Figure 9:
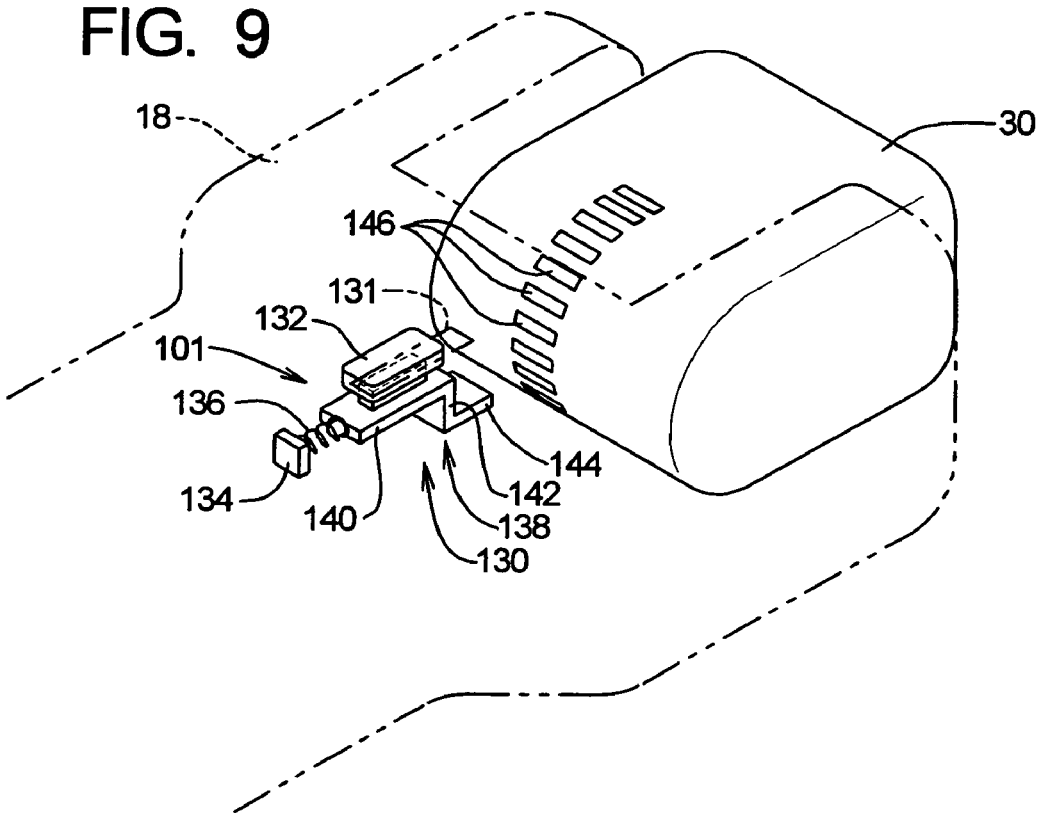
FIG. 9 is a perspective view of an alternative embodiment of the rotational locking mechanism.

In an alternative embodiment, referring to FIG. 9, the rotational locking mechanism 101 is provided in the central portion of the upper housing 18. Here a Z configuration locking leg 138 is provided with a catch lock button 132 extending through a catch lock slot 131 which provides an opening in the upper wall of the main upper housing 18. The button is connected to the upper horizontal leg 140 of the locking leg 138. The upper longitudinal leg 140 has at its back wall a compressive spring 136 which provides the compressive force to security the locking leg 138 into the desired female receiving holes 146 positioned equidistantly along the outer face of the spindle housing 30. The locking leg 138 has a vertical leg portion 142 and a lower longitudinal leg 144. The lower longitudinal leg 144 is provided to lock into the female receiving hole 146 and secure the spindle housing 30 in its desired rotational position.

The lower housing 14 and the middle housing 16 sizes are both dictated by the physical size of the rechargeable battery 40 and the motor 44. Thus, reaching into small confined spaces utilizing a strong motor and powerful rechargeable battery will be difficult if the upper housing vertical height or profile is the same depth as the middle housing 16 and or the lower housing 14.

Figure 1A:
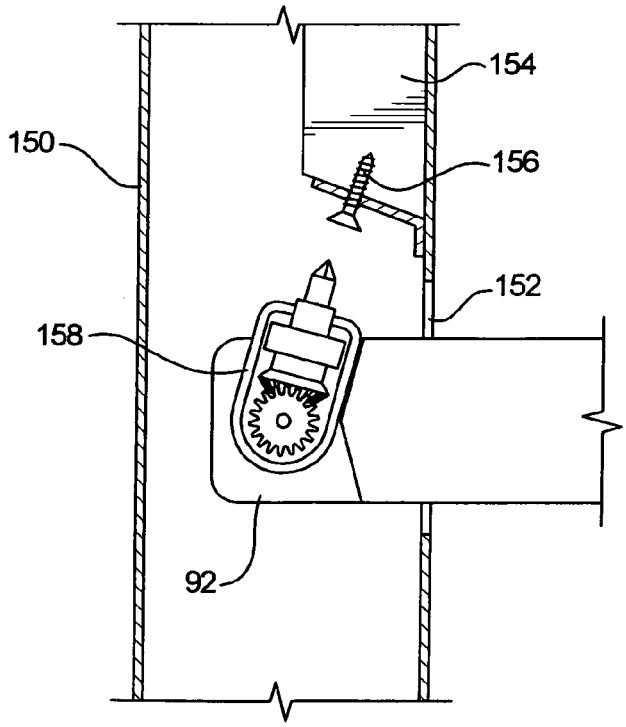
FIG. 1A is a section view of the handheld electric screwdriver inserted into a small working environment.
Figure 4:
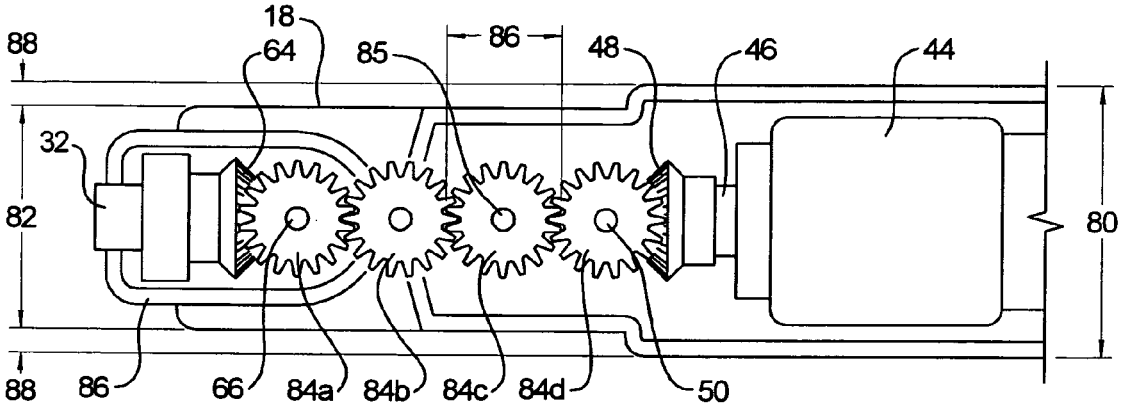
FIG. 4 is an elevation view of the handheld electric screwdriver showing a narrow upper housing height with four smaller diameter longitudinally aligned transmission gears.

Referring to FIG. 4, if the motor 44 is so large that it is restrictive as to accessing smaller spaces, providing a narrower upper housing height 82 can be beneficial for reaching into a confined space such as a car door 150 as seen in FIG. 1A.

In the vertical dimension, the upper housing height 82, FIG. 4, is defined by the diameter 86 of the longitudinally aligned spur gear's 58. Therefore, providing a smaller diameter spur gear 84 and increasing the number of longitudinally positioned spur gear's will narrow the upper housing height 82 but provide the same longitudinal length for the desired reaching capabilities into the smaller spaces.

Still referring to FIG. 4, a plurality of smaller diameter spur gears 84, in this case four spur gears, are shown arranged in the longitudinal direction extending forward into the upper housing 18. Similar to the previous discussion at FIGS. 2 and 3, the longitudinally aligned smaller spur gear's 84 include a first spur gear 84D which is connected to the lower transverse drive shaft 50. This lower transverse drive shaft 50 has a lower transverse miter gear 52 which interfaces with the drive shaft miter gear 48 extending from the motor drive shaft 46. The first small diameter spur gear 84D is connected to a second small diameter spur gear 84C which is positioned on an intermediate spur gear shaft 85. The purpose of the next two spur gears is to provide the transfer of rotational force to the upper transverse drive shaft 66 as previously discussed. The third intermediate small diameter spur gear 84B interfaces with the second spur gear 84C and continues the translation of rotational energy to the upper small diameter spur gear 84A which is connected to the upper transverse drive shaft 66. This upper transverse drive shaft 66 has an upper transverse miter gear 62 which interoperate with an upper spindle miter gear 64 to provide the rotational operation of the magnetic spindle shaft 32 within the smaller spindle housing 86. The operability of the smaller spindle housing 86 to rotate around the upper drive shaft 66 is the same as previously discussed above.

Figure 5:
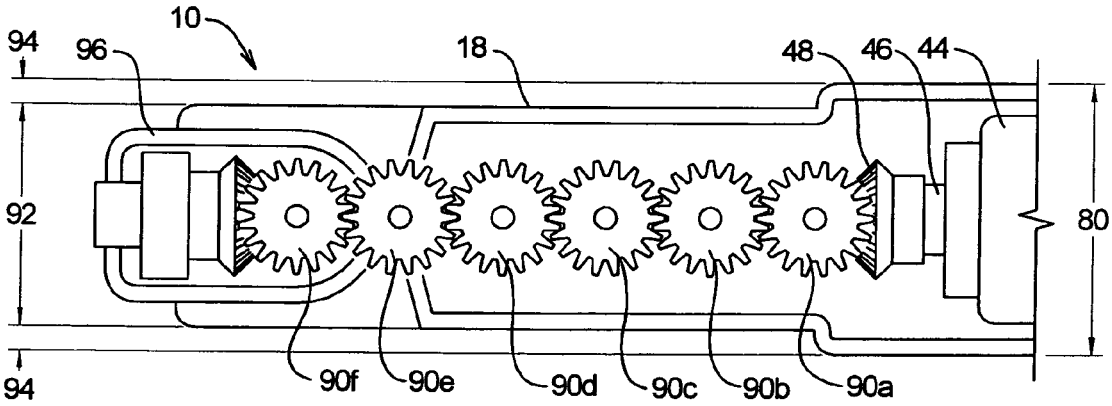
FIG. 5 is an elevation view of the handheld electric screwdriver showing a second narrower upper housing height with six smaller diameter longitudinally aligned transmission gears.

Referring to FIG. 5, a further alternative embodiment of a portable handheld electric screwdriver 10 is shown with an even smaller upper housing height 92 than the previously mentioned alternative embodiment. The longitudinal length of the upper housing 18 remains essentially the same, but instead of four longitudinally aligned spur gears as previously discussed, six longitudinally aligned spur gears, 90A through 90F are provided. This enables the user to position the reaching portion of the handheld screwdriver 10, the reaching portion being the upper housing 18, into even narrower and smaller confined spaces.

The overall housing height 92 of the upper housing 18 is only limited to the diameter of the individual spur gears and the upper housing casing itself.

Users may find that besides utilizing the significant rotational degrees of freedom of the spindle housing, additional angles may be desired. Because the spur gears can be rotated about one another, and no loss in drive shaft power will be noticed, additional hinges or rotational shafts can be provided centered on the various intermediate spur gear shafts as desired to provide for additional arm configurations.

Figure 5A:
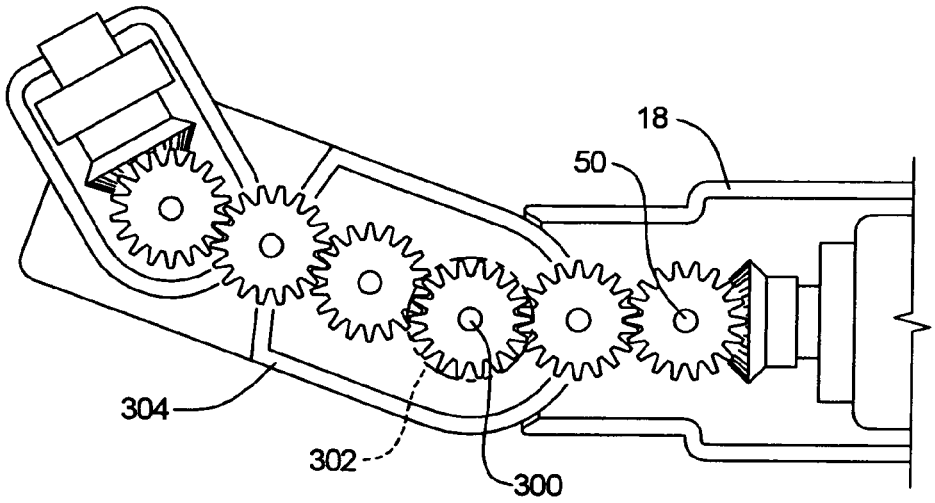
FIG. 5A is an elevation view of an alternative embodiment of the handheld electric screwdriver showing an intermediate transmission casing to provide additional rotational configurations.

Referring to FIG. 5A, one such other configuration includes providing an additional transversely aligned rotational shaft 300, which in this particular embodiment is shown centered on the longitudinally forward intermediate spur gear 302. In this particular embodiment, the transversely aligned rotational shaft 300 is essentially an extension of the spur gear support shaft 59, FIG. 2, as previously discussed in the above embodiments.

Still referring to FIG. 5A, the transversely aligned rotational shaft 300 extends transversely from one housing sidewall 51 to the other side, and is resting on ball bearings 54 embedded within the sidewall housings 51, similar to FIG. 2 as previously discussed.

Figure 5B:
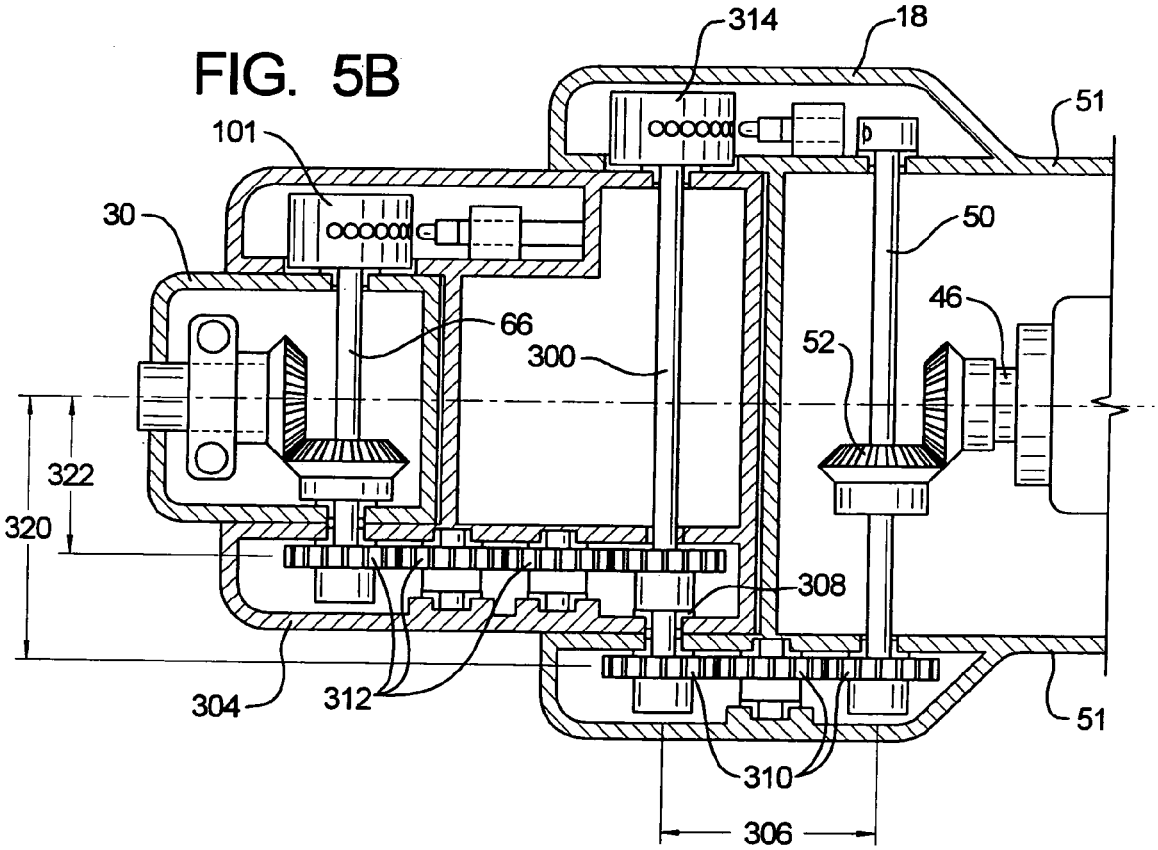
FIG. 5B is a plan view of an alternative embodiment of the handheld electric screwdriver showing an intermediate transmission casing to provide additional rotational configurations.

Still discussing the current alternative embodiment, and referring to both FIGS. 5A and 5B, the intermediate transmission casing 304 rotates around the transversely aligned rotational shaft 300, by connecting to the transversely rotational shaft 300 using ball bearings 308 enabling the intermediate transmission casing 304 to rotate independently from the rotational work being performed on the transversely aligned rotational shaft 300. The rotational work from the upper housing intermediate spur gears 310 is transmitted into the intermediate casing spur gears 312 which in turn translate the rotational work to the upper transverse drive shaft 66 as previously discussed in the aforementioned embodiments. Similar to the aforementioned embodiments, the spindle housing 30 can rotate about the upper transverse drive shaft 66 and be fixed in its desired rotational position.

As previously mentioned, the upper housing spur gears 310 are aligned in series along the longitudinal axis. These upper housing spur gears 310 are positioned off-center from the drive shaft center line 46. In the current embodiment, the upper housing spur gears 310 are positioned a transverse distance furthermost away from the drive shaft center line 46. The intermediate casing spur gears 312 are also longitudinally aligned in series and transversely offset from the drive shaft center line 46. In this particular embodiment, the intermediate casing spur gears 312 are transversely offset a lesser distance from the center line of the drive shaft 46 than the previously mentioned transverse offset distance.

As previously mentioned, the upper housing spur gears 310 are aligned in series along the longitudinal axis. These upper housing spur gears 310 are positioned a maximum transverse offset distance 320 from the drive shaft center line 46. Similarly, the intermediate casing spur gears 312 are also longitudinally aligned in series parallel with the drive shaft center line 46 but are also offset a intermediate transverse offset distance 322 which is a lesser distance thnt the upper housing spur gear maximum transfer offset distance 320.

The intermediate transverse casing 34 and the spindle housing 30 can be fixed in desired rotational positions through the use of the rotational locking mechanism 101 for the spindle housing 30, and the intermediate casing rotational locking mechanism 314. Similar degrees of freedom can be provided for both rotational locking mechanisms as previously discussed in the prior mentioned embodiments.

It is conceivable that additional intermediate transmission casings can be provided besides the previously described alternative embodiment. Additional intermediate transmission casings centered on additional transversely aligned rotational shafts and being provided with additional intermediate casing rotational locking mechanisms and transmissions would offer the portable electric handheld screwdriver 10 additional configurations to reach within small spaces to perform the desired work.

I claim:

1. A method to provide rotational work on a securing element located within a small space, said method comprising:

a. providing a housing having a main body and a reaching arm, the main body and reaching arm configured along a longitudinal, transverse and vertical axis system, b. providing in the main body a power source, a drive motor, a drive shaft, and a drive shaft center line, c. providing in the reaching arm a first transversely aligned drive shaft and a second transversely aligned drive shaft, a front section, a rear section, and a longitudinally aligned transmission, d. positioning the first transversely aligned drive shaft at the longitudinally rearward end of the rear section, e. connecting the first transversely aligned drive shaft to the drive shaft, f. positioning the longitudinally aligned transmission transversely off-center from the drive shaft center line, g. connecting the first transversely aligned drive shaft to the longitudinally aligned transmission, h. positioning the second transversely aligned drive shaft longitudinally forward of said first transversely aligned drive shaft, i. connecting said longitudinally aligned transmission to said second transversely aligned drive shaft, j. connecting said front section to said second transversely aligned drive shaft, k. allowing said front section to rotate freely about said second transversely aligned drive shaft, l. fixing said front section in a chosen rotational degree of freedom to work within said small space, m. securing a spindle in said front section along a radial axis from said second transversely aligned drive shaft, n. allowing said spindle to rotate about said radial axis, o. connecting said second transversely aligned drive shaft to said spindle, p. actuating the power source and driving the drive motor to drive the drive shaft, said drive shaft providing rotational work to said first transversely aligned drive shaft, said first transversely aligned drive shaft providing rotational work to said longitudinally aligned transmission, said longitudinally aligned transmission providing rotational work to said second transversely aligned drive shaft, said second transversely aligned drive shaft providing rotational work to said spindle, said spindle providing rotation work to said securing element.

2. An apparatus to accomplish rotational work on a securing element located within a small space, the apparatus comprising:

a. a main body and a reaching arm, the main body and reaching arm configured about a longitudinal, transverse and vertical axis system, b. the main body having a power source, drive motor, and a drive shaft, all arranged along the longitudinal axis, the drive motor having a cylindrical configuration, a motor profile height, and a catch lock, c. the reaching arm comprising a front section and a rear section, the rear section having a first transversely aligned drive shaft and a second transversely aligned drive shaft, said first transversely aligned drive shaft operatively connected to said drive shaft, said second transversely aligned drive shaft positioned a longitudinally aligned spacing distance forward of said first transversely aligned drive shaft, said rear section further having a longitudinally aligned transmission transversely offset from the drive motor centerline and out of the longitudinally aligned spacing distance, said transmission operatively connected to said first transversely aligned drive shaft and said second transversely aligned drive shaft, d. said front section operatively connected to rotate about said second transversely aligned drive shaft, said front section further having a spindle section, said spindle section comprising a cylindrical casing and arranged about a radial shaft, said radial shaft having an origin at the center of the second transversely aligned drive shaft, both front section and spindle section rotating in tandem about said second transversely aligned drive shaft, said spindle section operatively connected to said second transversely aligned drive shaft to rotate about said radial shaft.

3. The apparatus according to claim 2 wherein said front section is operatively connected to said second transversely aligned drive shaft to rotate about said second transversely aligned drive shaft with at least 360° of rotational freedom.

4. The apparatus according to claim 2 wherein said front section further comprises a rotational locking mechanism providing rotational locking of the spindle section about the second transversely aligned drive shaft at most every 45° increments.

5. The apparatus according to claim 4 wherein said rotational locking mechanism further comprises a cylindrical catchlock collar structurally attached to said front section and extending transversely through the reaching arm rear section, said cylindrical catchlock collar having a plurality of receiving pinholes positioned circumferentially equidistant about said cylindrical catchlock collar to receive a male catchlock, said male catchlock having a male catchlock pin configured to slidably insert into said receiving pinhole and to rotationally fix said cylindrical catchlock collar and corresponding front section at a rotational locking position.

6. The apparatus according to claim 4 wherein said rotation locking mechanism further comprises a central housing catchlock, said central housing catchlock positioned centrally within the rear section of the reaching arm, said central housing catchlock having a locking pin which slidably interchanges with one of a plurality of radially spaced receiving holes positioned in the front section around the center of the second transversely aligned drive shaft.

7. The apparatus according to claim 2 where in the front section further comprises a plurality of LED lights, whereby the illumination of the LED lights facilitates accurate use of the apparatus to perform rotational work on the securing element located within the small space.

8. The apparatus according to claim 2 wherein the first transversely aligned drive shaft is operatively connected to said drive shaft by a miter gear.

9. The apparatus according to claim 2 wherein said longitudinally aligned transmission comprises a first positioned transmission gear, a plurality of middle positioned transmission gears, and a second positioned transmission gear, said first positioned transmission gear operatively connected to said first transversely aligned drive shaft, said middle positioned transmission gears operatively connected to said first and second transmission gears, said second transmission gear operatively connected to said second transversely aligned drive shaft.

10. The apparatus according to claim 9 wherein said reaching arm further comprises a reaching arm length proportional to the number of transmission gears positioned along the longitudinal axis, and a reaching arm profile height proportional to the diameter of the longitudinally aligned transmission gears.

11. The apparatus according to claim 10 wherein the reaching arm length is less than or equal to 5 inches and the reaching arm profile height is less than or equal to 1¾ inches.

12. The apparatus according to claim 10 wherein the reaching arm length remains substantially equal to 3 inches and the reaching arm profile height is substantially ¾ of an inch.

13. The apparatus according to claim 2 wherein the second transversely aligned drive shaft is operatively connected to said spindle section by a miter gear.

14. The apparatus according to claim 13 wherein said spindle section is operatively connected to the front section by at least one bearing.

15. The apparatus according to claim 2 wherein said front section is operatively connected to said second transversely aligned drive shaft by at least one bearing.

16. The apparatus according to claim 2 wherein said rear section further comprises a main housing and a side housing, said main housing encompassing said first and second transversely aligned drive shaft's, said side housing structurally connected to said main housing and encompassing said longitudinally aligned transmission.

17. The apparatus according to claim 16 wherein said first and second transversely aligned drive shafts extend transversely through said main housing and into said side housing, whereby said first transversely aligned drive shaft provides rotational work to said transmission, said transmission providing rotational work to said second transversely aligned drive shaft, said second transversely aligned drive shaft providing rotational work to said spindle section.

18. An apparatus to accomplish rotational work on a securing element located within a small space, the apparatus comprising:

a. a main body and a reaching arm, the main body and reaching arm configured about a longitudinal, transverse and vertical axis system, b. the main body having a power source, drive motor, and a drive shaft, all arranged along the longitudinal axis, the drive motor having a cylindrical configuration and having a motor profile height, c. the reaching arm comprising a front section, at least one middle section, and a rear section, the rear section having a first transversely aligned drive shaft, each middle section having a middle transversely aligned drive shaft, the front section having a second transversely aligned drive shaft, said first transversely aligned drive shaft operatively connected to said drive shaft, said middle transversely aligned drive shafts each positioned a longitudinally aligned spacing distance forward of said first transversely aligned drive shaft, said reaching arm further having a longitudinally aligned transmission transversely offset from said longitudinally aligned spacing distances, said transmission operatively connected to said first transversely aligned drive shaft, said middle transversely aligned drive shafts, and said second transversely aligned drive shaft, d. each middle section operatively connected to rotate about each correlating middle transversely aligned drive shaft, e. said front section operatively connected to rotate about said second transversely aligned drive shaft, said front section further having a spindle section, said spindle section comprising a cylindrical casing and arranged about a radial shaft, said radial shaft having an origin at center of said second transversely aligned drive shaft, the front section and spindle section rotating in tandem about said second transversely aligned drive shaft, said spindle section operatively connected to said second transversely aligned drive shaft to rotate about said radial shaft.

19. An apparatus to accomplish rotational work on a securing element located within a small space, the apparatus comprising:

a. a main body and a reaching arm, the main body and reaching arm configured about a longitudinal, transverse and vertical axis system, b. the main body comprising a power source, drive motor, and a drive shaft, the power source, drive motor, and drive shaft arranged along the longitudinal axis, the drive motor having a cylindrical configuration and having a motor profile height, the drive shaft having a centerline positioned along the centerline of the main body, c. the reaching arm comprising a front section and a rear section, the reaching arm having a profile height not greater than the motor profile height, the rear section comprising:

i. a longitudinal forward portion, a longitudinal rearward portion, a first transversely aligned drive shaft, said first transversely aligned drive shaft arranged in the longitudinal rearward portion of the rear section, said first transversely aligned drive shaft operatively connected to said drive shaft, ii. at least two longitudinally aligned transmission gears including a first rearwardly positioned transmission gear, a second centrally positioned transmission gear, and a third forwardly positioned transmission gear, said first rearwardly positioned transmission gear operatively connected to said first transversely aligned drive shaft, said second centrally positioned transmission gear operatively connected to said first rearwardly positioned transmission gear, said third forwardly positioned transmission gear operatively connected to said second centrally positioned transmission gear, iii. A second transversely aligned drive shaft arranged in the longitudinal forward portion and operatively connected to said third forwardly positioned transmission gear, d. The front section comprising:

i. a longitudinal front portion, a longitudinal back portion, a spindle section, ii. said longitudinal front portion extending no greater than one half of the reaching arm profile height beyond the longitudinal forward portion of the rear section, iii. the longitudinal back portion operatively connected to rotate about said second transversely aligned drive shaft, iv. a spindle section having a cylindrical casing and arranged about a radial shaft, said radial shaft having an origin at the center of the first transversely aligned drive shaft, v. said spindle section operatively connected to said second transversely aligned drive shaft to rotate spindle section about said radial shaft, vi. the front section encompasing the spindle section and securing the spindle section against movement except for rotational movement about the raidal axis and the second transversely aligned drive shaft, vii. said front section having 210 degrees of rotational freedom about said second transversely aligned drive shaft.

20. An apparatus to accomplish rotational work on a securing element located within a small space, the apparatus comprising:

a. a main body and a reaching arm, the main body and reaching arm configured about a longitudinal, transverse and vertical axis system, b. the main body having a power source, drive motor, and a drive shaft, all arranged along the longitudinal axis, the drive motor having a cylindrical configuration and having a motor profile height, c. the reaching arm comprising a front section and a rear section, the rear section having a first transversely aligned drive shaft and a second transversely aligned drive shaft, said first transversely aligned drive shaft operatively connected to said drive shaft by a miter gear, said second transversely aligned drive shaft positioned a longitudinally aligned spacing distance forward of said first transversely aligned drive shaft, said rear section further having a longitudinally aligned transmission transversely offset from of said longitudinally aligned spacing distance, said transmission operatively connected to said first transversely aligned drive shaft and said second transversely aligned drive shaft by a first positioned transmission gear operatively connected to said first transversely aligned drive shaft, a plurality of middle positioned transmission gears operatively connected to said first positioned transmission gear, a second transmission gear operatively connected to said plurality of middle positioned transmission gears and second transversely aligned drive shaft, d. said front section operatively connected by at least one bearing to rotate about said second transversely aligned drive shaft with at least 360° of rotational freedom, said front section further having a spindle section, said spindle section comprising a cylindrical casing and arranged about a radial shaft, said radial shaft having an origin at the center of the second transversely aligned drive shaft, both front section and spindle section rotating in tandem about said second transversely aligned drive shaft, said spindle section operatively connected to said second transversely aligned drive shaft by a miter gear and positioned within the spindle section by a bearing to rotate about said radial shaft, said front section further comprising:

i. a rotational locking mechanism providing rotational locking of the spindle section about the second transversely aligned drive shaft at most every 45°, ii. a plurality of LED lights, whereby the illumination of the LED lights facilitates accurate use of the apparatus to perform rotational work on the securing element located within the small space, e. whereby actuation of the power switch allows power from the battery to drive the motor, which in turn drives the drive shaft, said drive shaft providing rotational work to the miter gear connected to the first transversely aligned drive shaft, said first transversely aligned drive shaft providing rotational work two said transmission, said transmission providing rotational work to said second transversely aligned drive shaft, said second transversely aligned drive shaft providing rotational work to the mitre gear connected to said spindle, said spindle rotating about said radial shaft and providing rotational work to the securing device.

* * * * *